US005411251A

United States Patent [19]

Schmid et al.

[11] Patent Number: 5,411,251

[45] Date of Patent: May 2, 1995

[54] SHEET DELIVERY OF A PRINTING MACHINE WITH A FLOATING CONVEYOR

[75] Inventors: Gotthard Schmid, Nussloch; Arno Wirz, Bammental, both of Germany

[73] Assignee: Heidelberger Druckmaschinen AG, Heidelberg, Germany

[21] Appl. No.: 169,518

[22] Filed: Dec. 17, 1993

[30] Foreign Application Priority Data

Dec. 17, 1992 [DE] Germany ..... 42 42 730.4

[51] Int. Cl.[6] ..... B65H 29/24

[52] U.S. Cl. ..... 271/195; 271/204; 34/654

[58] Field of Search ..... 271/195, 82, 204–206; 406/88; 226/97; 101/230–232; 34/633, 646, 654, 660

[56] References Cited

U.S. PATENT DOCUMENTS

| | | | |
|---|---|---|---|
| 2,138,178 | 11/1938 | Lang | 34/660 |
| 3,231,165 | 1/1966 | Wallin et al. . | |
| 3,272,415 | 9/1966 | Wallin | 226/97 |
| 3,622,151 | 11/1971 | Range et al. | 271/195 X |
| 3,748,033 | 7/1973 | Harvey | 271/195 X |
| 3,975,057 | 8/1976 | Hurd | 271/195 X |
| 4,572,071 | 2/1986 | Cappel et al. | 271/195 X |
| 5,102,118 | 4/1992 | Vits . | |
| 5,222,726 | 6/1993 | Vits | 271/195 |

FOREIGN PATENT DOCUMENTS

| | | | |
|---|---|---|---|
| 761816 | 6/1967 | Canada | 226/97 |
| 576774 | 5/1933 | Germany . | |
| 1176672 | 4/1965 | Germany . | |
| 4141261 | 6/1993 | Germany | 271/195 |
| 458158 | 12/1936 | United Kingdom . | |
| 901906 | 7/1962 | United Kingdom . | |
| 1006394 | 9/1965 | United Kingdom . | |
| 89/09177 | 10/1989 | WIPO . | |

*Primary Examiner*—Cheryl L. Gastineau
*Assistant Examiner*—Boris Milef
*Attorney, Agent, or Firm*—Herbert L. Lerner; Laurence A. Greenberg

[57] ABSTRACT

Sheet delivery of a printing machine having a gripper system running on an endless conveyor includes air containers located adjacent the endless conveyor and being formed with a sheet-wide field of air-outlet openings, the gripper system including grippers for gripping a sheet of printing material at a leading edge thereof so that the sheet is floatingly conveyable by the endless conveyor over the sheet-wide field of air-outlet openings formed in the air containers, the endless conveyor having a capability of turning the sheet and depositing it on a sheet pile, at least one of the air containers extending over the sheet width and having air-outlet openings of varying shapes formed so that air is discharged therefrom in different directions, the one air container being chargeable with blowing air regulatable in accordance with specific requirements of the printing material of the sheet.

9 Claims, 3 Drawing Sheets

SHEET DELIVERY OF A PRINTING MACHINE WITH A FLOATING CONVEYOR

SPECIFICATION

The invention relates to a sheet delivery of a printing machine and, more particularly, to such a sheet delivery having a gripper system running on an endless conveyor, and air containers located adjacent the endless conveyor and being formed with a sheet-wide field of air-outlet openings, the gripper system including grippers for gripping a sheet of printing material at a leading edge thereof so that the sheet is floatingly conveyable by the endless conveyor over the sheet-wide field of air-outlet openings formed in the air containers and, after the sheet is turned, depositing it on a sheet pile.

German Patent 1 176 672 discloses a printing-machine sheet delivery of the foregoing general type. With this heretofore known machine, a printed sheet is taken-over from an impression cylinder by grippers revolving on chains, the sheet being gripped at its leading edge and being floatingly carried on an approximately horizontal stretch by an air flow fed through air outlets which are distributed over a sheet-wide field, the printed side of the sheet facing downwardly and, after the sheet has been turned, the sheet is deposited on a sheet pile, with the printed side of the sheet facing upwardly. For this purpose, air pipes or boxes are provided at a level in the delivery which is located below the grippers, the pipes or boxes having air outlets on a respective upper side thereof and being distributed mutually adjacent and in parallel with one another over the sheet width. The pipes or boxes are connected to the blowing-air system of the printing machine so that they can be regulated. This heretofore known arrangement seeks to improve the stability of the sheet in the central region during sheet transport; for this purpose, the supporting force of the air outlets provided in the machine center is increased by providing greater pressures or shorter spacings or distances with respect to the laterally disposed air outlets or by other means.

Contact-free transport of a sheet has been known heretofore from German Patent 576 774 wherein a sheet is described as being carried on one or more air flows along a straight conveyor path in a delivery of a printing machine.

It is accordingly an object of the invention to provide a printing-machine sheet delivery of the type generally described in the introduction hereto which includes further possibilities for improving a universal adaptation thereof to thin paper sheets as well as to cardboard of average thickness and other printing materials, while improving efficiency and results.

With the foregoing and other objects in view, there is provided, in accordance with the invention, a sheet delivery of a printing machine having a gripper system running on an endless conveyor, comprising air containers located adjacent the endless conveyor and being formed with a sheet-wide field of air-outlet openings, the gripper system including grippers for gripping a sheet of printing material at a leading edge thereof so that the sheet is floatingly conveyable by the endless conveyor over the sheet-wide field of air-outlet openings formed in the air containers, the endless conveyor having means for turning the sheet and depositing it on a sheet pile, at least one of the air containers extending over the sheet width and having air-outlet openings of varying shapes formed so that air is discharged therefrom in different directions, the one air container being chargeable with blowing air regulatable in accordance with specific requirements of the printing material of the sheet.

Varying positions and varying shapes of the air outlets formed in the air container, box or tube, different air outflow directions and air outflow profiles, as well as variations in pressure ratio, provide for optimum sheet travel on an air cushion in accordance with or as a function of the quality and character of the sheet to be printed and the respective processing technique applied. According to the invention, the air container may be connected to the air supply system of the printing machine in a conventional manner or may be equipped with its own air supply system, such as is provided by fans or the like, in order to improve the individual regulation of the air cushion carrying the sheet.

In order to be able to look into or through the delivery, in accordance with other features of the invention, the at least one air container has walls at least partly formed of transparent material, which may be a plastic material. Thus, the air box or tube box may advantageously be made entirely of transparent plastic material or may have walls which are only transparent in part.

In accordance with a further feature of the invention, the air containers are interchangeable cassettes assemblable in the sheet delivery so as to form a contact-free sheet-carrier, the sheet-carrier having varying properties for meeting different requirements. The pressman is thereby able to provide optimum conditions for sheet travel on an air cushion, even after installation of the sheet feeder, by the fact that he or she can change the cassettes when necessary or desirable.

In accordance with an added feature of the invention, the air outlets formed in the air containers or interchangeable cassettes have varying geometric outlines or shapes.

In accordance with an additional feature of the invention, the air containers or interchangeable cassettes are formed with a plurality of air chambers, and the air outlets are connected in groups to different air channels of a varyingly regulatable air flow.

In accordance with yet another feature of the invention, groups of the air outlets of identical geometric outline or shape, respectively, are located amongst one another.

In accordance with yet a further feature of the invention, the interchangeable cassettes have connection means for connecting an interior air space thereof or air chambers subdividing the interior space to at least one air channel of a varyingly regulatable air flow.

In accordance with yet an added feature of the invention, the interchangeable cassettes have regulatable fans.

In accordance with yet an additional feature of the invention, the sheet delivery includes means for closing at least some of the air outlets of the interchangeable cassettes.

In accordance with another feature of the invention, the sheet delivery includes a stationary sheet guide disposed above the endless conveyor for floatingly conveying the sheet, at least one suction slit being formed in a rear end of the stationary sheet guide for smoothening the sheet.

In accordance with a concomitant feature of the invention, the air outlets are formed as blowing nozzles directed opposite to a conveying direction of the sheet.

Other features which are considered as characteristic for the invention are set forth in the appended claims.

Although the invention is illustrated and described herein as embodied in a sheet delivery of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
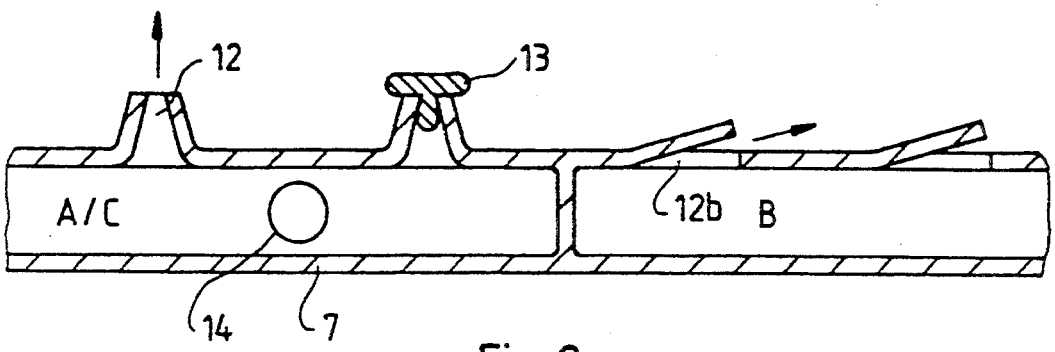
FIG. 2 is an enlarged fragmentary, longitudinal sectional view of FIG. 1 showing an air container or box of the sheet delivery according to the invention in the form of a cassette.
Figure 2A:
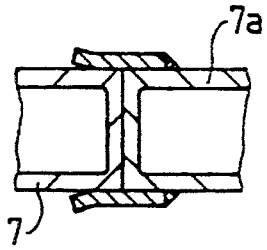
Figure 3:
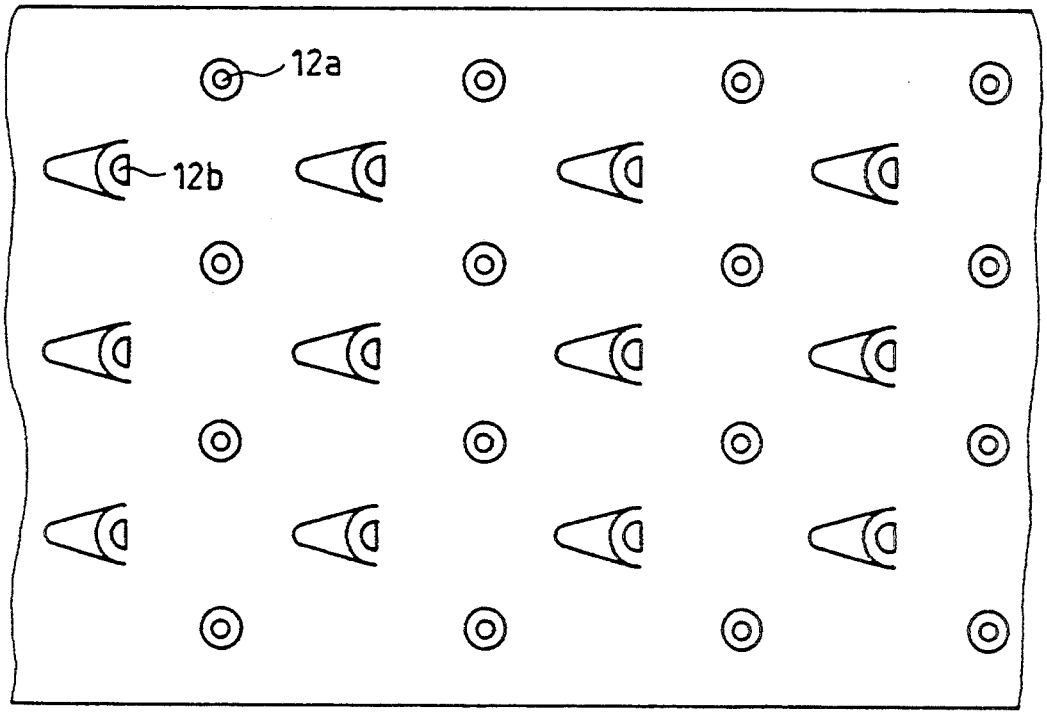
Figure 4:
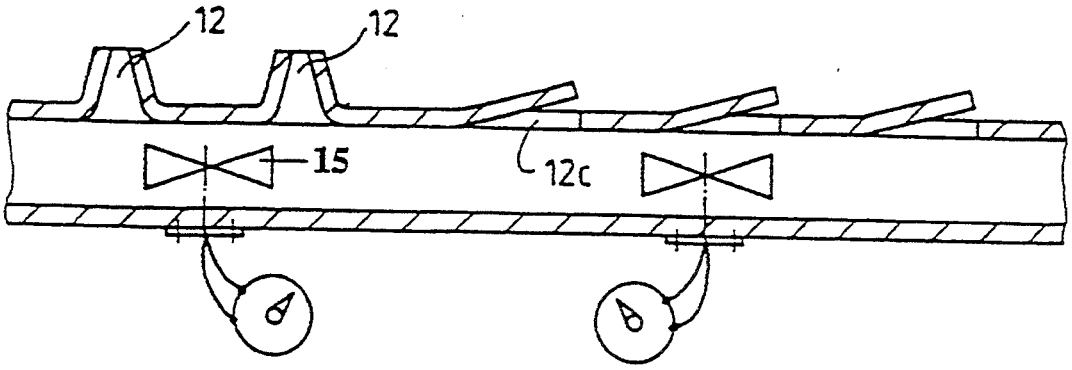
Figure 5:
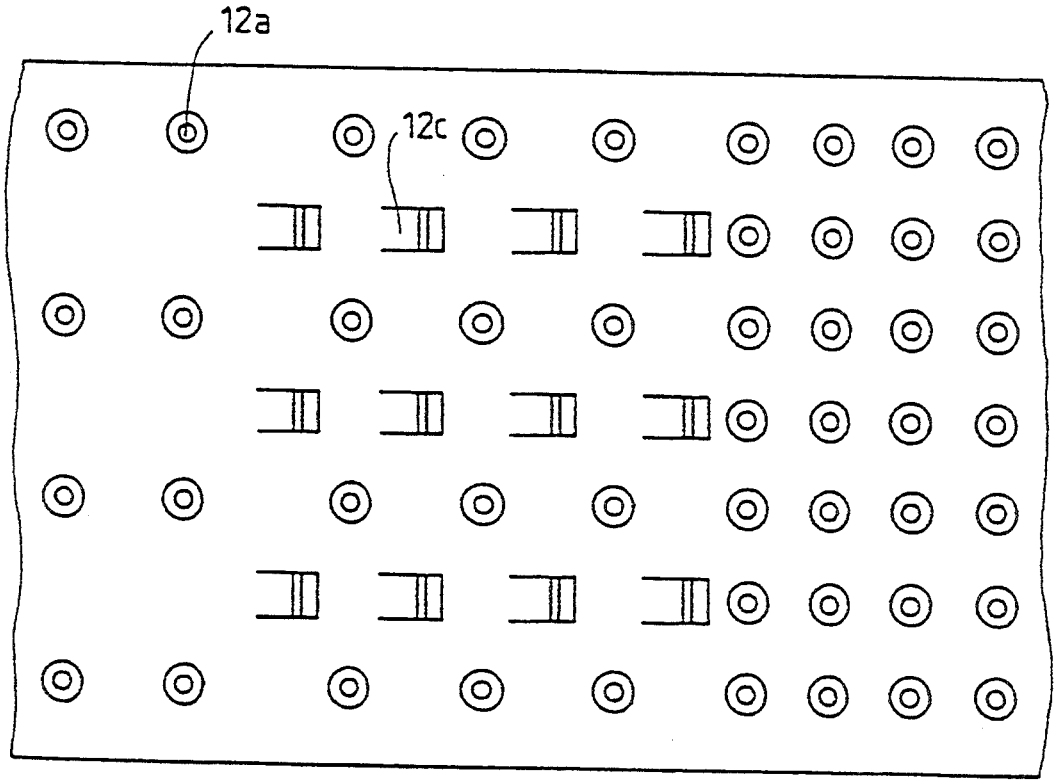

FIG. 2*a* is a fragmentary view of FIG. 2 showing a modification in the construction of the cassette;

FIG. 3 is a top plan view of FIG. 2;

FIG. 4 is a view like that of FIG. 2 of another embodiment of the cassette; and FIG. 5 is a top plan view of FIG. 4.

Figure 1:
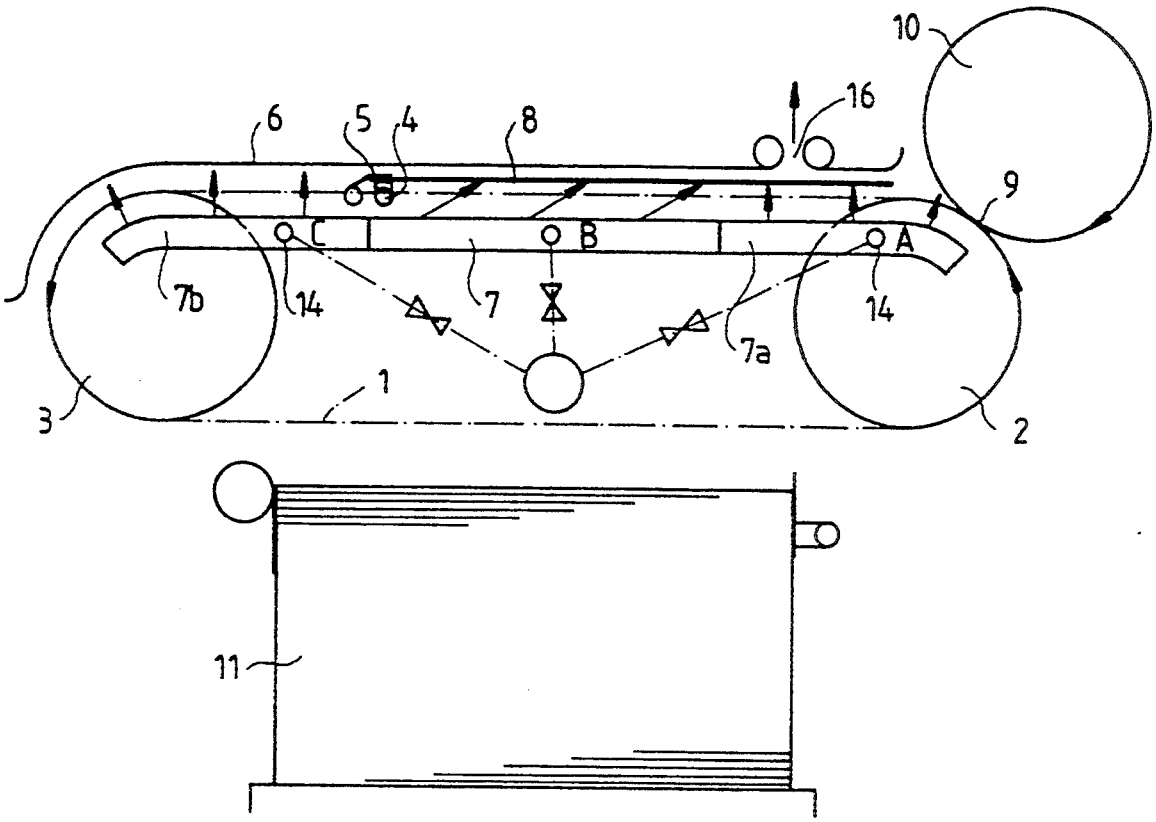
FIG. 1 is a diagrammatic side elevational view of a sheet delivery of a printing machine constructed in accordance with the invention.

Referring now to the drawings and, first, particularly to FIG. 1 thereof, there is shown therein a sheet delivery according to the invention, which has an endless conveyor with endless chains 1 guided so as to revolve around deflector rollers, pulleys or sprocket wheels 2 and 3. Gripper bars 4 on which sheet grippers 5 are arranged adjacent and spaced apart from one another are fastened to the chains 1 transversely to a sheet-conveying direction from the right-hand side to the left-hand side of the figure. At an upper side of the sheet delivery, a stationary sheet guide 6 is disposed. Below the level of the upper strand of the endless chains 1, an air box 7 is provided which extends across the sheet width, an upper side of the air box 7 being formed with air outlets; the air box 7 has an interior space which is connectible to the air system of the printing machine or to its own air supply system. In the embodiment illustrated in FIG. 1, the air box 7 is formed of transparent plastic material in order to permit viewing from above into and through the delivery. In accordance with a further inventive concept, an interchangeable cassette of transparent plastic material may be used instead of the fixedly mounted air box 7.

The printed sheet 8 formed of paper, cardboard or other printing material is grasped by the leading edge thereof in the nip or tangential location 9 by the sheet grippers 5 and taken-up by an impression cylinder 10 so that the sheet 8, with its printed side facing downwardly, is guided through the sheet delivery and finally deposited onto the sheet pile 11 of the delivery after it has passed the pulley or sprocket wheel 3. On an approximately horizontal conveying path through the delivery and a succeeding deflection about the pulley or sprocket wheel 3, the sheet 8 is carried by an air cushion and, by its nonprinted side, is braced against the sheet guide 6 which is formed of a metal plate. After having been deflected about the pulley or sprocket wheel 3, the printed side of the sheet 8 faces upwardly as the sheet is deposited on the sheet pile 11.

In a particular embodiment of the invention, the air outlets provided for producing an air cushion which carries the sheet 8 have varying geometric shapes or outlines and are formed in interchangeable cassettes extending approximately over the length of the horizontal conveying path so that a sheet-wide field of air outlets is provided underneath the sheet 8. Especially in the case of relatively long conveying paths, it is advisable to subdivide the interchangeable cassettes 7 in the conveying direction of the sheet 8 so that, between end cassettes 7*a* and 7*b*, one or more intermediate cassettes 7 are provided. The shape of the end cassettes 7*a* and 7*b* may be matched or adapted to the pulleys or sprocket wheels 2 and 3, respectively, if necessary or desirable. It is also possible to provide a fixed arrangement of the end cassettes 7*a* and 7*b*, and to form them as simple air boxes.

Taking into account the characteristics of the sheet to be printed, air outlets having varying geometric outlines and having means for effecting the escape of air in different directions are provided on the upper side of the air box and the interchangeable cassette 7, respectively. FIGS. 2 and 2*a*, respectively, show an air box with air chambers A,B,C, and an interchangeable cassette 7 having air outlets 12 each of which has a substantially round outlet cross-section and is either directed perpendicularly upwards or at an inclination to the rear against the sheet-conveying direction, such air outlets 12 being disposed in a sheet-wide field of an air box 7 and an interchangeable cassette 7, respectively, in rows offset with respect to each other so that the upwardly directed air outlets 12*a* form an air cushion carrying the sheet, and the inclined air outlets 12*b* stretch the sheet 8, which is gripped at its leading edge by the sheet grippers 5, rearwardly opposite to the conveying direction. It is also possible to block individual air outlets, for example, by means of inserted stoppers 13, slides disposed in the cassette or other appropriate means, so as to ensure a better adaptation to thin paper qualities. In the embodiment shown in FIGS. 2 and 3, the interior space of a respective interchangeable cassette 7 is connected to the air system of the printing machine via air lines 14. It is recommended that the air pressure in the interchangeable cassettes 7 be individually regulated by separate regulating means, as indicated schematically in FIG. 1.

The embodiment of the invention according to FIGS. 4 and 5 is an air box 7 or an interchangeable cassette 7 having their own separate air system formed of motor-driven fans 15 which, by means of a potentiometer or other regulating means, permit a zonal regulation based upon the quality of the sheets to be printed. Moreover, FIG. 5 shows that the respective cross-sectional shape of the air outlets 12 may have a geometry deviating from a circular one, for example, a slit 12*c* formed of a tongue-shaped cut-out, with the thus-formed tongue thereof partially bent upwardly.

Air boxes 7 or interchangeable cassettes 7 of different shapes are selected on the basis of the properties of the sheets to be printed and are assembled or fitted together so as to form a contact-free sheet guide either in accordance with specific requirements prior to the delivery of the printing machine (FIG. 2*a*), or by permitting the pressman to effect a modification at a later date by changing cassettes so as to achieve a smear-free sheet delivery, with the printed areas facing downwardly, for a minimum make-ready time, in particular with respect to thin paper sheets and cardboard of average thickness.

Fine adjustment or regulation is performed by influencing the air flow. By means of built-in partitions provided in the interchangeable cassettes, the air flow at the sides may differ from that in the sheet center, if necessary or desirable; different intensities of the air flow and different outflow directions, as viewed over the sheet width, are thus achievable.

In addition to the stretching effect on the sheet caused by the blowing air escaping from the interchangeable cassettes opposite to or against the conveying direction, in accordance with a further inventive concept, a suction-air slit 16 may be provided also at the front end of the stationary sheet guide 6 immediately after the sheet transfer from the impression cylinder 10, in order to smoothen the sheet. The suction-air slit 16 may extend over the sheet width and apply suction to the trailing end of the sheet when it passes the suction-air slit 16, thereby drawing the sheet against the sheet guide 6. The suction in the suction-air slit 16 may be turned on and off, respectively, in accordance with the working cycle of the printing machine.

We claim:

1. Sheet delivery of a printing machine having a gripper system running on an endless conveyor, comprising interchangeable air cassettes removably disposed adjacent the endless conveyor and having a sheet-wide field of air-outlet openings formed therein, the gripper system including grippers for gripping a sheet of printing material at a leading edge thereof so that the sheet is floatingly conveyable by the endless conveyor over said sheet-wide field of air-outlet openings formed in said air cassettes, said endless conveyor having means for turning the sheet and depositing it on a sheet pile, at least one of said air cassettes extending over the sheet width and having air-outlet openings of varying shapes formed so that air is discharged therefrom in different directions, and means for charging said air cassettes with blowing air regulatable in accordance with specific requirements of the printing material of the sheet, wherein said air cassettes form a contact-free sheet-carrier having varying properties for meeting different requirements.

2. Sheet delivery according to claim 1, wherein each of said interchangeable cassettes are formed with a plurality of air chambers, and said air-outlet openings are connected in groups to different air lines of a varyingly regulatable air flow.

3. Sheet delivery according to claim 2, wherein groups of said air outlet openings of identical geometric outline, respectively, are located amongst one another.

4. Sheet delivery according to claim 1, wherein said interchangeable cassettes have connection means for respectively connecting a respective interior space of said cassettes to at least one air line of a varyingly regulatable air flow.

5. Sheet delivery according to claim 4, wherein said interior space is subdivided into air chambers, and at least one of said air chambers is connected to said one air line.

6. Sheet delivery according to claim 1, wherein said interchangeable cassettes have regulatable fans.

7. Sheet delivery according to claim 1, including means for closing at least some of said air outlet openings of said interchangeable cassettes.

8. Sheet delivery according to claim 1, including a stationary sheet guide disposed above said endless conveyor for floatingly conveying the sheet, at least one suction slit being formed in a rear end of said stationary sheet guide for smoothening the sheet.

9. Sheet delivery according to claim 1, wherein said air-outlet openings are formed as blowing nozzles directed opposite to a conveying direction of the sheet.

* * * * *